United States Patent [19]

Abbott

[11] Patent Number: 5,055,274

[45] Date of Patent: Oct. 8, 1991

[54] CATALYTIC CONVERTER AND SUBSTRATE SUPPORT WITH ONE PIECE HOUSING

[75] Inventor: James R. Abbott, Jackson, Mich.

[73] Assignee: Tennessee Gas Pipeline Company, Lincolnshire, Ill.

[21] Appl. No.: 483,399

[22] Filed: Feb. 22, 1990

Related U.S. Application Data

[63] Continuation-in-part of Ser. No. 306,915, Feb. 6, 1989.

[51] Int. Cl.[5] ..... F01N 3/10

[52] U.S. Cl. ..... 422/171; 422/172; 422/179; 422/180; 422/190; 422/194; 422/221; 422/222; 55/DIG. 30; 60/299; 60/301; 29/890; 29/890.08; 181/282

[58] Field of Search ..... 422/170, 171, 177, 179, 422/180, 182, 172, 190, 193, 194, 211, 221, 222; 55/DIG. 30; 60/299, 301; 29/890, 890.08; 181/282

[56] References Cited

U.S. PATENT DOCUMENTS

| | | | |
|---|---|---|---|
| 3,523,590 | 8/1970 | Straw | 181/282 |
| 4,049,388 | 9/1977 | Scheitlin et al. | 60/301 X |
| 4,163,042 | 7/1979 | Lynch | 422/179 |
| 4,218,422 | 8/1980 | Schock et al. | 60/301 X |
| 4,239,733 | 12/1980 | Foster et al. | 422/180 X |
| 4,347,219 | 8/1982 | Noritake et al. | 422/180 |
| 4,744,440 | 5/1988 | Hanson | 181/250 X |
| 4,863,700 | 9/1989 | Ten Eyck | 422/180 X |

*Primary Examiner*—Lynn Kummert
*Attorney, Agent, or Firm*—Harness, Dickey & Pierce

[57] ABSTRACT

A catalytic converter of the automotive type comprising a reduced central oval section that compresses a support mat around a catalyst substrate, the reduced central section comprising radially inwardly biased ribs that are parallel to the longitudinal axis of the converter.

The converter can be made by inserting a catalyst substrate and surrounding support mat through the open end and into the central portion of an oval sheet metal tube, after which the reduced section and longitudinal ribs are formed in the central portion of the tube to compress the mat and securely engage the substrate, and the ends of the tube are pinched together to form sealed end closures with gas flow passages therein.

26 Claims, 2 Drawing Sheets

CATALYTIC CONVERTER AND SUBSTRATE SUPPORT WITH ONE PIECE HOUSING

CROSS-REFERENCE TO RELATED APPLICATIONS

This is a continuation-in-part application of copending application Ser. No. 306,915, filed Feb. 6, 1989 and entitled "Catalytic Converter With One Piece Housing".

BACKGROUND OF THE INVENTION

This invention relates to catalytic converters useful in motor vehicle exhaust gas systems and, in particular, to converters of the type having one or more ceramic monoliths or substrates mounted inside of a sheet metal housing, the substrates containing a multiplicity of longitudinal straight-through-flow exhaust gas passages that are coated with catalyst. Such catalytic converters are intended for installation on motor vehicles as original equipment by the vehicle manufacturer or as aftermarket replacement for original equipment converters.

Typically, the metal housings for commercially acceptable converters of the type just described are of the so-called "pancake" or "clamshell" design; i.e., they comprise stamped upper and lower shells, which are substantially identical to each other, and which have mating, peripheral, side flanges that are welded together to lie in a plane containing the longitudinal axis of the housing. They are shaped to form an internal chamber in which the substrates are mounted by "L-shaped" or other known brackets. Another commercial form of catalytic converter housing comprises a tube with separate end cones welded at each end; i.e., a three-piece housing.

It is a purpose of the present invention to reduce the size and number of parts in a catalytic converter (as compared with known practical constructions) while at the same time increasing its effectiveness and improving its construction and manufacture. The present invention achieves the foregoing purpose by means of a substrate support in the form of a tubular converter body which is reduced in diameter at a central portion to compress a support mat around a catalyst substrate. Such substrate support provides a construction and manufacture that results in a converter that is relatively short in length, has few parts, has maximum effectiveness since 100% of the substrate end faces can be used, and has improved accuracy in supporting the substrate.

It is also a purpose of the present invention to provide a converter of the type described above, and the method of making it, which has a one-piece, metal, tubular housing instead of a two-piece "clamshell" housing or the three-piece end cone type housing. A converter according to the invention performs at least as well as one having a prior type housing and has a construction that is inherently economical to produce and can be mass-manufactured in the large volumes required to supply original equipment converters directly to manufacturers of automobiles and trucks for factory installation in exhaust systems.

The present invention in preferred form involves the use of an open-ended oval metal tube. The catalyst coated ceramic substrate with a circumferential support mat is centrally placed inside of the oval tube. Thereafter, the central section of the oval metal tube is reduced in diameter to compress the mat and securely engage the substrate. During the diameter reducing process inwardly projecting longitudinal ribs are formed in the reduced section to maintain uniformity of reduction and mat compression. Annular raised ribs are formed near each open end of the tube and the open ends of the tube are pinched together by radial deformation to close the ends of the tube and form an inlet aperture in one end and an outlet aperture in the other end. In a preferred embodiment, the above procedure is used to position and secure two substrates in the housing, one being coated with three-way catalysts to convert nitrous oxides, carbon monoxide, and hydrocarbons and the other being coated with oxidation catalysts to convert carbon monoxide and hydrocarbons.

Other features and advantages of the invention will become apparent or be discussed in the detailed description.

DETAILED DESCRIPTION OF THE PREFERRED EMBODIMENT

Figure 1:
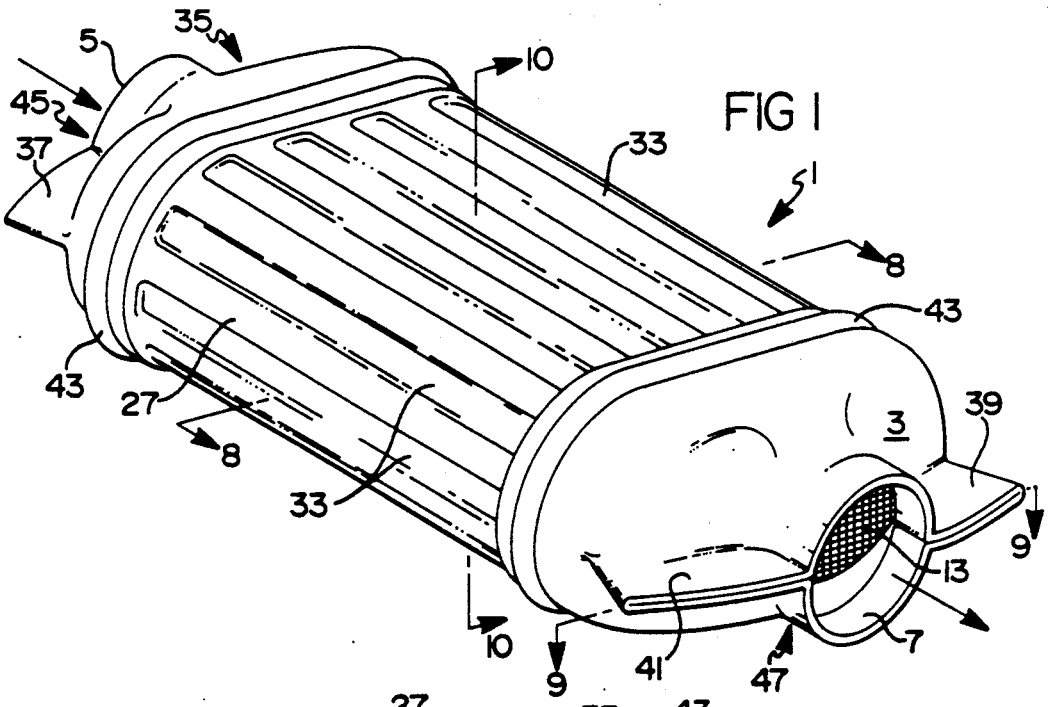
FIG. 1 is a perspective view of a catalytic converter according to the invention.

In accordance with the present invention, a catalytic converter 1 has a one piece, tubular metal housing 3 with an integral inlet 5 at one end and an integral outlet 7 at the other end. A first ceramic monolith, honeycomb-type, catalyst substrate 9 with circumferentially surrounding and narrower band-like support mat 11 is positioned inside of the housing 3 adjacent the inlet 5 end of the housing. A second substrate 13 with its circumferentially surrounding and narrower band-like support mat 15 is positioned inside of the housing 3 adjacent the outlet 7 end of the housing and is longitudinally separated from substrate 9. The substrates 9 and 13 are of the same but smaller cross section as the housing 3 and their outer peripheral surfaces are uniformly spaced radially inwardly from the inner wall of the housing. The ends of the support mats are located inwardly of the end faces of the substrates as shown in the drawings. The resilient and insulative shock absorbent support mats are composed of a gas impervious, vermiculite based material, available on the open market, which is intumescent and expands substantially upon heating. The support mats have a thickness of approximately ¼" which is radially compressed during assembly to approximately one-half of its initial thickness.

The substrates 9 and 13 subdivide the space inside of the housing 3 into three chambers; i.e., an inlet chamber 17 between the inlet 5 and the inlet side of the substrate 9, a central chamber 19 between the outlet side of substrate 9 and the inlet side of substrate 13, and an outlet chamber 21 between the outlet side of substrate 13 and the outlet 7. Though not illustrated, it is to be understood that each substrate has a great number of longitudinally extending straight-through-flow gas passages and that these are coated with appropriate catalysts. Thus, exhaust gas can flow straight through the converter 1 from inlet passage 5 to outlet passage 7, being treated as it flows through the longitudinal passages in the catalyst elements defined by substrates 9 and 13. The substrate 9 may contain three-way catalysts to convert nitrous oxides, carbon monoxide, and hydrocarbons to nitrogen, water, and carbon dioxide. The substrate 13 may contain an oxidation catalyst and secondary air may be supplied to chamber 19 to convert carbon monoxide and hydrocarbons to water and carbon dioxide. A secondary air inlet and conduit 23 is illustrated diagrammatically in FIG. 9.

According to the invention tooling (or dies) 25 is utilized to radially reduce in cross-section a central portion or annular ring 27 of the oval tubular housing 3. The tooling 25 is provided with spaced raised portions 31 that form spaced longitudinal ribs 33 in the reduced section 27 of the tubular body. In the preferred embodiment the ribs are substantially equally spaced circumferentially around the reduced portion of the housing 3 and the width of the longitudinal ribs and the space separating each adjacent pair of longitudinal ribs are substantially equal.

Preferably, the depth of the reduced section including longitudinal ribs is about half the thickness of the mats 11 and 15. This provides sufficient support to the substrates 9 and 13 yet still allows some relative movement of the substrates with respect to the housing (due to resiliency in the mats) without contact with the substrates. The longitudinal length of the ribs 33 and reduced section 27 are approximately the same as or slightly less than the longitudinal width of the mats 11 and 13 and the central chamber 19.

Radial reduction of the cross-section of a catalytic converter is disclosed in pending U.S. patent application Ser. No. 156,838, filed Apr. 1, 1988 (which is a division and continuation-in-part of application Ser. No. 873,684, filed June 12, 1986 by inventors Leonard J. Dryer and Thomas J. Schwarte). Application Ser. No. 156,838, owned by the assignee of the present invention, is directed to a three-piece converter having a central reduced portion that is circular in cross-section and separate cones or bushings that are welded at each end. The radial reduction disclosed in Ser. No. 156,838, however, does not provide satisfactory uniform reduction in a converter housing that is oval in cross-section as in the present case.

Figure 9:
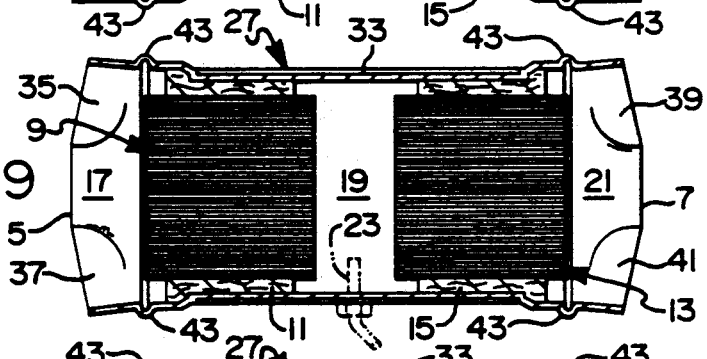
FIG. 9 is a view similar to FIG. 7 (and corresponds to a section along plane 9—9 of FIG. 1) showing the pinched down ends of the tube from which the converter housing is formed.
Figure 10:
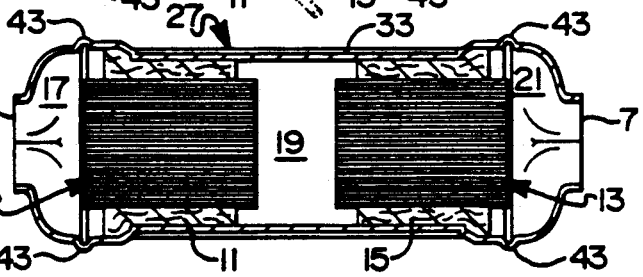
FIG. 10 is a cross section view along the line 10—10 of FIG. 1 showing the pinched down ends of the tube from which the converter is formed.
Figure 2:
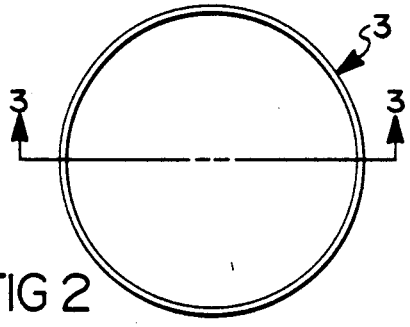
FIG. 2 is an end view of a round metal tube from which the housing of FIG. 1 may be fabricated.
Figure 4:
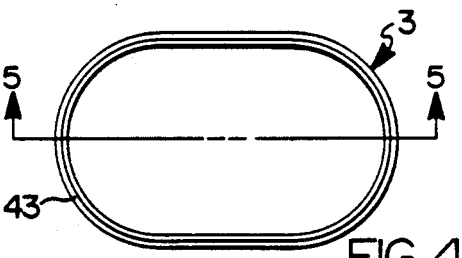
FIG. 4 is an end view of the tube of FIG. 1 after it has been shaped into an oval with a pair of outwardly projecting annular ribs former therein.

As seen in FIGS. 1, 9 and 10, at each end of the housing 3 opposite sides of the major diameter of the oval tube (the major diameter portions ordinarily being parallel to the bottom of the motor vehicle) are in engagement to close the ends of the housing. At the inlet end the opposite major diameter portions of the tubular housing 3 are radially deformed or squeezed together to produce the integral inlet passage 5 and the pinched-together corners 35 and 37 on opposite sides of the passage 5. The pinched corners 35 and 37 comprise a double thickness of metal and the two layers are preferably welded together to form and serve as closure means that seals the inlet end of the housing except for the formed passage 5. Similarly, at the outlet end the opposite major diameter portions of the tubular housing 3 are radially deformed to produce the integral outlet passage 7 and the pinched-together corners 39 and 41 on opposite sides of the passage 7. The two metal layers of the corners 39 and 41 are preferably welded together whereby they serve as closure means to seal the outlet end, of the housing except for the passage 7. Pinched-in end closures of this general type in exhaust gas mufflers are shown and described in U.S. Pat. No. 3,648,803 of Mar. 14, 1972 of Robert A. Heath and Ronald J. Martoia, owned by the assignee of the present invention.

Prior to radially deforming the ends of the housing 3 to form the pinched-in end closures and formed passages 5 and 7, an annular rib 43 is formed in the housing near each end of the housing 3 as shown in FIGS. 1, 4, 5, 9 and 10. While the annular rib 43 is preferably formed as a radially raised rib, it can also be formed to project inwardly into the housing 3 (in which case the substrates and mats are inserted into the housing before the annular ribs 43 are formed at each end of the housing). The annular ribs 43 serve to help maintain the oval shape of the housing 3 during the pinching operation and help control the extent of deformation to the housing. The annular ribs 43 furnish radial support to the ends of the housing 3 adjacent the substrates 9 and 13 during pinching down of the housing ends thereby helping to avoid crushing the corners of the adjacent substrates. Preferably ribs 43 are longitudinally located along housing 3 to correlate with the inlet end of substrate 9 and the outlet and of substrate 13. In this manner the overall length of the converter 1 is kept to a minimum and the adjacent ends of the fragile substrates 9 and 13 are protected from damage during crimping of the end closures.

Figure 6:
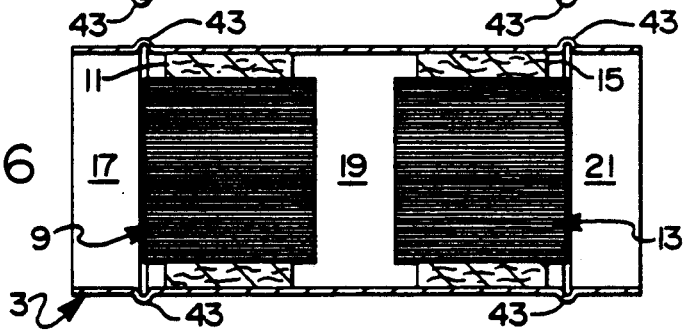
FIG. 6 is a view similar to FIG. 5 but shows two catalyst coated substrates wrapped with support mats inserted into the tube.

In general, a converter used in automatic exhaust systems may be of round or other cross sections, such as oval. The oval cross section illustrated herein is ordinarily preferred for automotive exhaust systems because the converter can be shaped to occupy minimum vertical space beneath the vehicle. In making the converter 1 of this invention it is convenient to start with commercially available round metal tubing of uniform diameter and metal thickness, open at both ends, and radially compress it from opposite sides with tubing dies to form the oval shape of FIG. 4. Thereafter, the annular ribs 43 are formed in the housing 3 to produce the configuration shown in FIG. 4. The substrates 9 and 13 with their centrally located peripheral support mats 11 and 15 are of the same outer oval size as the inside of the ovalized housing 3 and they are inserted into either or opposite open ends of the housing until they are properly placed in their predetermined location within the housing. Preferably, they are inserted into opposite open ends of the housing until the outer ends of substrates 9 and 13 align with the ribs 43 as shown in FIG. 6.

The next step is to radially uniformly reduce the central portion of the housing 3 by suitable known means into a reduced diameter or ring portion 27 of a length slightly less than the longitudinal length of the housing occupied by the mats 11 and 15 and the central chamber 19. As a result of substantially uniformly radially compressing the mats 11 and 15 around the outside of the substrates 9 and 13, respectively, to about one-half the original or free state thickness of the mats, substrates 9 and 13 are firmly though somewhat resiliently supported centrally within the housing 3. The reduced portion 27 comprises a plurality of radially inwardly projecting longitudinal ribs 33 that are preferably circumferentially uniformly spaced about the housing 3. Ribs 33 furnish structural rigidity and stiffness to the reduced portion 27 and generally to the housing 3. Ribs 33 also help maintain reduced portion 27 in its uniformly reduced oval cross-section, thereby helping to maintain uniform radial compression on the mats 11 and 15. In this manner both reduced portion 27 and mats 11 and 15 apply sufficient radial pressure to retain the substrates 9 and 13 in their predetermined position and serve as the sole means to shock mount and support the substrates.

Figure 7:
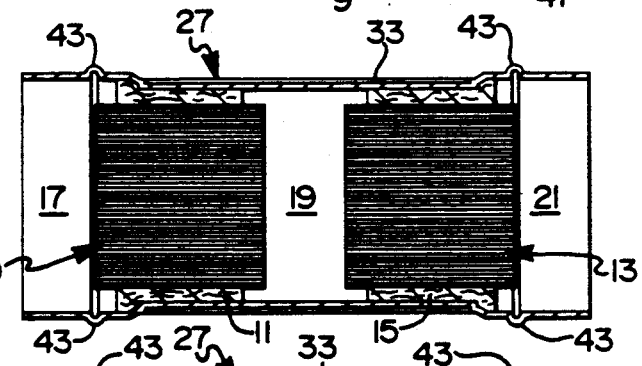
FIG. 7 is a view similar to FIG. 6 but shows the reduced diameter portion and longitudinal ribs formed in the reduced portion holding the substrates in place.

After formation of the reduced portion 27 and the ribs 33 so that the substrates 9 and 13 are securely held in place, the inlet end closure 45 (comprising corners 35 and 37 and inlet passage 5) and the outlet end closure 47 (comprising corners 39 and 41 and outlet passage 7) are formed. Axial pressure parallel to the short diameter of the oval housing 3 is applied to the ends of the housing to deform them together into the pinched end closures 45 and 47 while still maintaining the remainder of the oval housing cross section to preserve the clearance between the housing 3 and the outer edges of the substrates 9 and 13. While the reduced portion 27 including longitudinal ribs 33 can be formed in the housing 3 before the end closures are formed, as shown in FIG. 7, it is possible to simultaneously press-form the reduced portion 27 including the longitudinal ribs 33, and the end closures 45 and 47 thereby eliminating one operation.

Further, the end closures 45 and 47 can be formed one end at a time or both simultaneously. Since at least one embodiment of the converter is symmetrical, the same tooling can be used to form one end at a time; it being necessary only to simply reverse the housing end for end to perform the desired operation.

Figure 8:
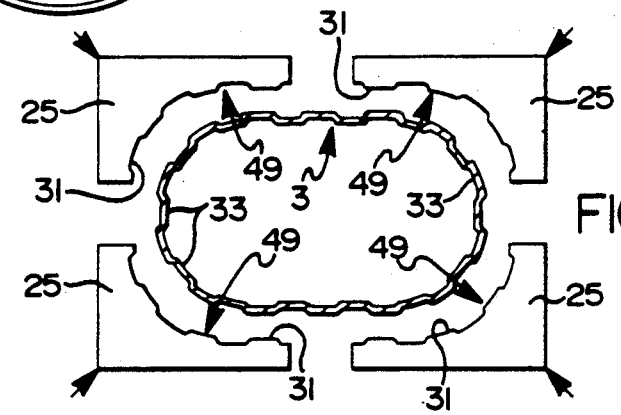
FIG. 8 is an enlarged section along the line 8—8 of FIG. 1 and shows the tooling used to form the reduced portion and longitudinal ribs.
Figure 3:
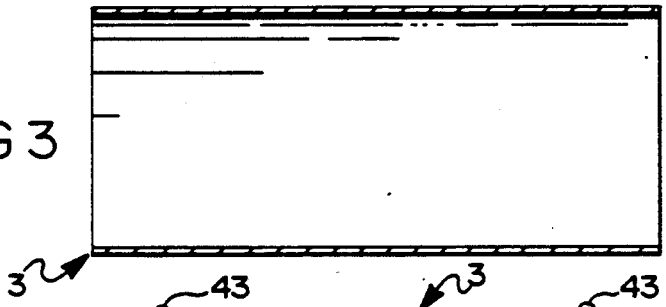
FIG. 3 is an enlarged section along the line 3—3 of FIG. 2 showing that the tube is of uniform diameter and thickness and has smooth walls.
Figure 5:
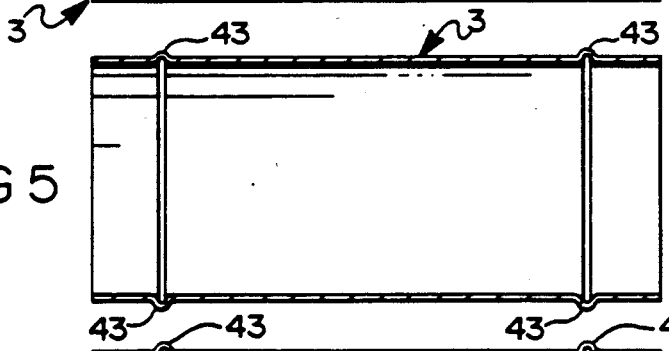
FIG. 5 is an enlarged section along the line 5—5 of FIG. 4.

In FIG. 8, four compression dies 25 each having a curvilinear forming surface 49 conforming to one quarter of the general oval cross sectional configuration of the housing 3, are positioned about and simultaneously driven radially inwardly (as shown by arrows) about the central portion 27 of the housing 3 thereby resulting in the housing wall being substantially uniformly radially deformed and driven into compressing contact with the mats 11 and 15. The axial width of each forming surface 49 is selected to be substantially equivalent to the predetermined longitudinal length of the reduced portion 27 desired. The forming surfaces 49 of the dies 25 include a plurality of the spaced raised portions 31 which form the longitudinal ribs in reduced annular ring portion 27 during the reducing operation. Preferably the angular extent of surfaces 49 is such that when the compression dies 25 reach their inwardmost travel the respective surfaces 9 cooperate to define a continuous 360° surface. Advantageously, the dies 25 assure that mats 11 and 15 are properly reduced in thickness and compressed radially between the substrates and the inner wall of the housing tube.

In use, the converter 1 would normally be secured into an exhaust system by welding or clamping of exhaust system conduits to the inlet 5 and outlet 7 defined by end closures 45 and 47, respectively. Exhaust gas flows through the longitudinal passages of the substrates which are catalyst coated to reduce oxides of nitrogen and to oxidize hydrocarbons and carbon monoxide in order to achieve acceptable emission levels. If a vermiculite base mats 11 and 15 are used, heat from the reaction during initial operation of the converter will cause the mats to significantly expand thereby enhancing the tightness of the connection between the substrates 9 and 13 and the housing 3 to act along with the relatively high frictional resistance to resist slipping of the substrates relative to the housing 3. For use in either original equipment or in the aftermarket, the substrates of the converter 1 will be selected, sized, and treated with catalyst to produce acceptable emission levels for a wide variety of different engines.

As an example of approximate size for present day U. S. automotive applications, the substrates 9 and 13 may vary from approximately 1" to approximately 6" long and, depending on the size of the converter, have oval diameter ranges of approximately 3.15" to 4.15" in the short diameter and approximately 4.75" to 6.60" in the long diameter. The substrates are uniformly spaced about ⅛" from the inner surface of the reduced portion 27 and about ¼" from the inner surface of non-reduced portions of the housing 3. The overall length of the housing 3 after forming of the pinched ends may be approximately 15 to 15½" for one embodiment of converter 1. This length can be significantly less than that needed to support the substrate in a conventional manner in a similarly shaped body by means of L-shaped support rings or brackets. Additionally, 100% of the end faces, and therefore the longitudinal passages, of the substrate can be used for exhaust gas flow treatment, thereby increasing the converter's effectiveness.

Since the mats 11 and 15 are heated when used in an exhaust system and expand to such a degree that they tightly hold the substrates in place, the need for conventional mechanical assistance, L-rings, ribs, or partitions to hold the substrates is eliminated. Accordingly, the converter 1 has a minimum number of parts, only three if only one substrate and mat are used, and the method of supporting the substrate by uniform radial compression applied through reduced portion 27 promotes accuracy and efficiency in manufacturing. The converter 1 can be shipped with reduced likelihood of impact damage to the brittle ceramic substrate material because of the protection provided by the pinched ends and by the unique method of mounting the substrate which provides clearance for the corners of the substrate.

The engagement of each combined substrate and mat with the housing is such as to permit them to be longitudinally inserted into the housing 3. Ordinarily, the peripheral outer surface of the substrates that engages the mat is rough so that the mat does not tend to slip longitudinally along the substrate even before heat expansion radially compresses it against the outer substrate surface. However, the inner wall of housing 3 is smooth and there is a possibility of slippage between the outer surface of the mat and the housing until heat is applied to and the mat expands. The pre-heat condition exists during the period between manufacture and actual use on a vehicle. During this period much handling of the converter occurs. Slippage at the interface between the mat and housing is avoided, however, by the holding means provided by the reduced portion 27 and the longitudinal ribs 33. Ribs have been used heretofore in converters with "clamshell" housings in conjunction with metal mesh type substrate supports to help hold the supports in place during actual use of the converter. In the present invention, radial compression of the support mats as a result of both the reduced portion 27 with longitudinal ribs 33 and heat expansion holds them in place during actual use of the converter.

The converter illustrated contains two separate catalyst elements. One of the elements could be omitted so that the converter would contain just one catalyst member but still embody the one piece housing and reduced portion with longitudinal rib construction described herein.

While the converter is shown as symmetrical about a longitudinal axis through the center line of passages 5 and 7, it will be recognized that the structure and method described would also enable one or both passages to be transversely offset from the longitudinal axis. Further, if desired, a known type of heat shield may be attached to the converter housing 3 by welding or otherwise.

Modifications may be made in the specific features shown and described without departing from the spirit and scope of the invention.

What is claimed is:

1. In a catalyst converter for use in a motor vehicle exhaust system, said converter including a tubular body having an inlet and outlet means for the gas flow inside the tube, a catalyst substrate having a tubular central portion positioned inside the body, and a support mat surrounding the central portion of the substrate, the improvement wherein said tubular body is one-piece and has a central, generally cylindrical, reduced diameter portion radially compressed against the mat and the mat radially compressed against the substrate to hold and locate the substrate in a substantially fixed longitudinal position in the body, said reduced diameter portion comprising first portions compressed radially inwardly by a first predetermined amount, and longitudinal second portions compressed radially inwardly from said first portions by a second predetermined amount and making line contact with the outer periphery of the mat.

2. The improvement as claimed in claim 1 wherein said first portions define rib means that are parallel to the longitudinal axis of said tubular body.

3. The improvement as claimed in claim 2 wherein each of said rib means and each of said second portions have a lateral width that is substantially equal.

4. The improvement as claimed in claim 1 wherein said mat is composed of a material that expands significantly upon heating and thereby increases the radial compression between the substrate and reduced diameter portion.

5. The improvement as claimed in claim 1 wherein said mat and said substrate extend longitudinally, said mat is composed of fibrous material, and the length of the mat is about 50–90% of the length of the substrate.

6. The improvement as claimed in claim 5 wherein the longitudinal extension of said mat is about 70% of the longitudinal extension of the substrate.

7. The improvement as claimed in claim 1 wherein the ends of said body are formed to define said gas inlet means at one end and said gas outlet means at the other end.

8. The improvement as claimed in claim 1 wherein said body and said substrate are oval in cross section.

9. The improvement as claimed in claim 1 wherein said reduced diameter portion is deformed radially inwardly relative to the support mat by an amount that is sufficient to compress the support mat to about one-half the original or free-state thickness of the mat.

10. The improvement as claimed in claim 1 wherein said mat and said reduced diameter portion comprise the only means for supporting yet allowing some relative movement of said substrate with respect to the body without contact with the substrate.

11. The improvement as claimed in claim 1 wherein said mat is composed of a heat expandable fibrous material and extends longitudinally by an amount that is about 50–90% of the length of said substrate, said mat being compressed by said central reduced diameter portion to about one-half the original or free state thickness thereof.

12. A catalytic converter for use in exhaust systems of motor vehicles comprising a one-piece sheet metal housing of elongated tubular shape and having a longitudinal axis and opposite ends extending transversely to said longitudinal axis, one of said ends defining a gas inlet end for the converter and the other of said ends defining a gas outlet end for the converter, opposite sides of said housing at said gas inlet end being in engagement to form an inlet end closure for said gas inlet end of the housing, said inlet end closure having a gas inlet passage for gas to flow into the housing, opposite sides of said housing at said gas outlet end being in engagement to form an outlet end closure for said gas outlet end of the housing, said outlet end closure having a gas outlet passage for gas to flow out of the housing, the sheet metal of said housing forming said inlet and outlet end closures and serving to seal the opposite ends of the tubular housing except for said gas inlet passage and said gas outlet passage, and a gas treatment catalyst means positioned in the housing for treating exhaust gases flowing from the gas inlet passage to the gas outlet passage, said gas treatment catalyst means having an outer periphery and being supported by a substantially uniformly radially reduced diameter portion of said housing, said reduced diameter portion being generally cylindrical and including a plurality of circumferentially separated longitudinal ribs which engage the outer periphery of said catalyst means to hold and locate said catalyst means in substantially fixed position in said housing.

13. The improvement as claimed in claim 12 wherein said catalyst means comprises a ceramic monolith substrate having longitudinal gas flow passages coated with catalyst, said substrate having an outer peripheral surface of substantially the same shape as and corresponding in cross-section to the cross-section defining the inside surface of the tubular housing, and said outer peripheral surface being spaced inwardly from the inside surface of said housing, and an annular intumescent support band having an inside surface extending around and engaging said outer peripheral surface of said substrate and an outside surface engaging the inside surface of said tubular housing.

14. The improvement as claimed in claim 13 wherein said support band is wrapped about said substrate and both extend longitudinally, said support band being shorter than the substrate and having opposite longitudinal ends spaced inwardly from and disposed adjacent to the respective opposite longitudinal ends of said substrate.

15. The improvement as claimed in claim 14 wherein said reduced diameter portion is deformed radially inwardly by an amount that is sufficient to compress the support band to about one-half the original or free-state thickness of the band.

16. The improvement as claimed in claim 12 comprising means to resist deformation formed in a nonreduced diameter portion of said housing, surrounding said substrate during formation of said inlet and outlet end closures.

17. The improvement as claimed in claim 16 wherein said deformation resisting means comprises a pair of raised transverse annular ribs formed in said housing, with one rib near each of said housing.

18. The improvement as claimed in claim 17 wherein said catalyst means includes an inlet face, and one of said annular ribs is located at a point on said housing corresponding to the inlet face of said catalyst means.

19. The improvement as claimed in claim 18 wherein said catalyst means includes an outlet face and the other of said annular ribs is located at a point on said housing corresponding to the outlet face of said catalyst means.

20. The improvement as claimed in claim 16 wherein said deformation resisting means comprises a pair of radially projecting transverse annular ribs formed in said housing, with one rib near each of said housing.

21. The improvement as claimed in claim 20 wherein said catalyst means includes a gas inlet face and a gas outlet face, and one of said annular ribs is located at a point on said housing substantially corresponding to the inlet face of said catalyst means and the other of said annular ribs is located at a point on said housing substantially corresponding to the outlet face of said catalyst means.

22. The improvement as claimed in claim 12 wherein said housing and catalyst means are oval in cross section.

23. The improvement as claimed in claim 12 wherein said catalyst means comprises a first catalyst member located near the inlet end of said housing and a second catalyst member located near the outlet end of said housing, said first and second catalyst members being longitudinally spaced from each other and the space between the first and second catalyst members forming a central chamber in said housing.

24. The improvement as claimed in claim 23 including means for injecting secondary air into said central chamber, said second catalyst member comprising an oxidation catalyst.

25. The improvement as claimed in claim 23 wherein said first catalyst member comprises a first ceramic monolith substrate having longitudinal gas flow passages coated with catalyst and an outer peripheral surface, said first catalyst member including a first annular intumescent support mat having an inside surface extending around and engaging said outer peripheral surface of said first substrate and an outside surface engaging the inside surface of said tubular housing, said second catalyst member comprising a second ceramic monolith substrate having longitudinal gas flow passages coated with catalyst and an outer peripheral surface, said second catalyst member including a second annular intumescent support mat having an inside surface extending around and engaging said outer peripheral surface of said second substrate and an outside surface engaging the inside surface of said tubular housing, and wherein said reduced diameter portion of said tubular housing engages said first and second support mats to hold said first and second substrates in said housing.

26. The improvement as claimed in claim 12 wherein adjacent ones of said longitudinal ribs are spaced apart by a portion of said reduced diameter portion.

* * * * *

UNITED STATES PATENT AND TRADEMARK OFFICE

CERTIFICATE OF CORRECTION

PATENT NO. : 5,055,274

DATED : October 8, 1991

INVENTOR(S) : James R. Abbott

It is certified that error appears in the above-identified patent and that said Letters Patent is hereby corrected as shown below:

Col. 7, line 14, After "converter" insert --1--.

Col. 9, line 26, Claim 20, After "each" insert --end--.

Signed and Sealed this

Fourth Day of May, 1993

*Attest:*

Michael K. Kirk

MICHAEL K. KIRK

*Attesting Officer*

*Acting Commissioner of Patents and Trademarks*